US012344919B2

(12) United States Patent
Mann et al.

(10) Patent No.: US 12,344,919 B2
(45) Date of Patent: Jul. 1, 2025

(54) ALUMINUM-BASED ALLOY

(71) Applicant: Obshchestvo S Ogranichennoy Otvetstvennost'yu "Obedinennaya Kompaniya Rusal Inzhenerno-Tekhnologicheskiy Tsentr", Krasnoyarsk (RU)

(72) Inventors: Viktor Khrist'yanovich Mann, Krasnoyarsk (RU); Aleksandr Nikolaevich Alabin, Krasnoyarsk (RU); Aleksandr Petrovich Khromov, Krasnoyarsk (RU); Sergey Viktorovich Val'chuk, Krasnoyarsk (RU); Aleksandr Yur'evich Krokhin, Krasnoyarsk (RU); Dmitriy Olegovich Fokin, Krasnoyarsk (RU); Roman Olegovich Vakhromov, Krasnoyarsk (RU); Pavel Olegovich Yur'ev, Krasnoyarsk (RU)

(73) Assignee: ORSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

( * ) Notice: Subject to any disclaimer, the term of this patent is extended or adjusted under 35 U.S.C. 154(b) by 390 days.

(21) Appl. No.: 17/850,859

(22) Filed: Jun. 27, 2022

(65) Prior Publication Data

US 2022/0325387 A1 Oct. 13, 2022

Related U.S. Application Data

(63) Continuation of application No. PCT/RU2019/001038, filed on Dec. 27, 2019.

(51) Int. Cl.
*C22C 21/08* (2006.01)
*C22F 1/047* (2006.01)

(52) U.S. Cl.
CPC ..... *C22C 21/08* (2013.01); *C22F 1/047* (2013.01)

(58) Field of Classification Search
CPC ..... C22C 21/08; C22F 1/047
See application file for complete search history.

(56) References Cited

U.S. PATENT DOCUMENTS

| | | | |
|---|---|---|---|
| 5,908,518 A | 6/1999 | Hoffmann | |
| 6,337,147 B1 | 1/2002 | Haszler | |
| 8,500,926 B2 | 8/2013 | Ichitani | |
| 2003/0143102 A1* | 7/2003 | Matsuoka | C22C 21/04 420/532 |
| 2008/0257462 A1 | 10/2008 | Tagata et al. | |
| 2019/0249285 A1 | 8/2019 | Bes et al. | |

FOREIGN PATENT DOCUMENTS

| | | | |
|---|---|---|---|
| AT | 524571 | A4 | 7/2022 |
| CN | 1643172 | C | 7/2005 |
| CN | 101736183 | A | 6/2010 |
| CN | 110337502 | B | 10/2019 |
| DE | 60002061 | T3 | 11/2008 |
| EP | 1975263 | A1 | 10/2008 |
| JP | H04268038 | A | 9/1992 |
| JP | 2007186747 | A | 7/2007 |
| JP | 2016180141 | | 10/2016 |
| RU | 2230131 | C1 | 6/2004 |
| RU | 2663446 | C1 | 8/2018 |
| RU | 2683399 | C1 | 3/2019 |
| WO | 2007020041 | A2 | 2/2007 |

OTHER PUBLICATIONS

Search Report dated Aug. 31, 2020 in connection with Russian patent application No. 2020115035, 2 pages.
Office Action dated Jan. 27, 2022 in connection with Chinese Application No. 2019800933616, 3 pages.
Supplementary European search report dated Apr. 29, 2022 in connection with European Application No. 19957641.4 , 4 pages.
Preliminary Office Action dated Mar. 14, 2023 in connection with Brazilian Patent Application No. BR 11 2021 005581-9 , 4 pages.
International Search Report and Written Opinion dated Aug. 20, 2020 in connection with International Application No. PCT/RU2019/001038, 7 pages.
Notice of Comment from Korean Patent and Trademark Office dated Jun. 2, 2023, in reference to WO2007/020041, 5 pages.

* cited by examiner

*Primary Examiner* — Jessee R Roe
(74) *Attorney, Agent, or Firm* — Baker & McKenzie LLP

(57) ABSTRACT

The invention relates to the field of metallurgy of aluminum-based materials and may be used for the manufacture of products operating in corrosive environments under high loads, in particular, at elevated and cryogenic temperatures. The new aluminum alloy with a structure comprising an aluminum solution, precipitations and an eutectic phase formed by elements such as magnesium, manganese, iron, chromium, zirconium, titanium and vanadium, is claimed. Besides, the alloy additionally contains silicon and scandium, wherein at least 75% of the share of each element from the group of zirconium and scandium form precipitations with the lattice of type $L1_2$ in the amount of at least 0.18% vol and the particle size of no more than 20 nm, with the specified redistribution of alloying elements.

3 Claims, No Drawings

ALUMINUM-BASED ALLOY

CROSS-REFERENCE TO RELATED APPLICATIONS

This application is a continuation of and claims priority to PCT Application No. PCT/RU2019/001038 filed Dec. 27, 2019, which is incorporated herein by reference in its entirety for all purposes.

TECHNICAL FIELD OF THE INVENTION

The invention relates to the field of metallurgy of aluminum-based materials and may be used for the manufacture of products (including welded structures) operating in corrosive environments (humid atmosphere, fresh, seawater and other corrosive environments) under high loads, in particular, at elevated and cryogenic temperatures. The material can be produced in the form of rolled products, for example, slabs, plates and rolled sheets, extruded sections and pipes, forgings, other wrought semi-finished products, as well as in the form of powders, flakes, granules, etc.

The proposed alloy is primarily intended for use in vehicles such as hulls of boats and other ships, hull parts, plating and other loaded members of aircraft, truck and railway tanks, in particular, for transportation of chemically active substances, as well as for use in the food industry, etc.

PRIOR ART

Due to their high corrosion resistance, weldability, high elongation values and their ability to operate at cryogenic temperatures, wrought alloys of the Al—Mg system (series 5xxx) have been widely used for products operating in corrosive environments, in particular, they are intended for use in river and seawater (water transport, pipelines, etc.), tanks for transportation of liquefied gas and chemically active liquids.

The main disadvantage of alloys of series 5xxx is the low level of strength properties of as-annealed wrought semi-finished products; for example, the yield strength of alloys of type 5083 after annealing does not usually exceed 150 MPa (see Industrial aluminum alloys: Reference book. S. G. Aliev, M. B. Altman, S. M. Ambartsumyan et al. Moscow: Metallurgy, 1984).

One of the ways to improve the strength properties of as-annealed alloys 5xxx is additional alloying with transition metals, among which Zr and, to a lesser extent, Hf, V, Er and some other elements have gained the widest use. The principal distinctive feature of such alloys, in this instance, from other known alloys of the Al—Mg system (of type 5083) is the content of elements forming dispersoids, in particular, with the lattice of type $L1_2$. In this instance, the combined effect of increasing the strength properties is achieved by solid-solution hardening of the aluminum solid solution, mainly, with magnesium, and the presence in the structure of various secondary phases of precipitations formed during homogenization (heterogenization) annealing.

So, an alloy claimed by Alcoa is known (RU patent 2431692). The material contains (% wt): magnesium 5.1-6.5, manganese 0.4-1.2, zinc 0.45-1.5, zirconium up to 0.2, chromium up to 0.3, titanium up to 0.2, iron up to 0.5, silicon up to 0.4, copper 0.002-0.25, calcium up to 0.01, beryllium up to 0.01, at least one element from the group: boron, carbon, each up to 0.06, at least one element from the group: bismuth, lead, tin, each up to 0.1, scandium, silver, lithium, each up to 0.5, vanadium, cerium, yttrium each up to 0.25, at least one element from the group: nickel and cobalt, each up to 0.25, the balance is aluminum and unavoidable impurities, with the total magnesium and zinc content of 5.7-7.3% wt and the total iron, cobalt and/or nickel content of no more than 0.7% wt, the balance is aluminum and unavoidable impurities. Among the disadvantages of this alloy, the relatively low overall level of strength properties, which sometimes limits the use, should be noted. The presence of many small additives reduces the production rate, which affects adversely the performance of foundry facilities, and the high content of magnesium leads to a decrease in processability and corrosion resistance.

A much greater effect of increasing the strength properties than that in alloys of type 5083 is reached with the combined content of scandium and zirconium additives. In this instance, the effect is achieved by the formation of a much larger amount of precipitations (with the typical size of 5-20 nm), resistant to high-temperature heating during deformation processing and subsequent annealing of wrought semi-finished products, which provides a higher level of strength properties.

For example, a material based on the Al—Mg system, alloyed jointly with zirconium and scandium additives, is known; in particular, CRISM "Prometey" claimed the material, disclosed in RU patent 2268319, which is known as alloy 1575-1. The alloy is characterized by a higher level of strength properties than alloys of types 5083 and 1565. The claimed material contains (% wt) magnesium 5.5-6.5%, scandium 0.10-0.20%, manganese 0.5-1.0%, chromium 0.10-0.25%, zirconium 0.05-0.20, titanium 0.02-0.15%, zinc 0.1-1.0%, boron 0.003-0.015%, beryllium 0.0002-0.005%, and the balance is aluminum. Among the disadvantages of the material, the content of a large amount of magnesium should be noted, which sometimes affects adversely the processability during deformation processing, and the presence of the $\beta$-$Al_8Mg_5$phase in the final structure leading, in some instances, to a decrease in corrosion resistance.

A material claimed in U.S. Pat. No. 6,139,653 of Kaiser Aluminum is also known. An alloy based on the Al—Mg—Sc system, which additionally contains elements selected from the group including Hf, Mn, Zr, Cu and Zn, in particular (% wt) 1.0-8.0% Mg, 0.05-0.6% Sc as well as 0.05-0.20% Hf and/or 0.05-0.20% Zr, 0.5-2.0% Cu and/or 0.5-2.0% Zn, is claimed. In a particular version, the material may contain additionally 0.1-0.8% wt Mn. Among the disadvantages of the claimed material, the relatively low values of strength properties should be noted with the magnesium content at the lower limit as well as the low corrosion resistance and the low processability during deformation processing with the magnesium content at the upper limit. At the same time, to ensure a high level of properties, it is necessary to regulate the ratio of the size of particles formed by such elements as Sc, Hf, Mn and Zr.

A material, claimed by Aluminum Company of America and described in U.S.D Pat. No. 5,624,632, is known. The aluminum-based alloy contains (% wt) magnesium 3-7%, zirconium 0.05-0.2%, manganese 0.2-1.2%, silicon up to 0.15% and about 0.05-0.5% of elements, forming precipitations, which are selected from the group: Sc, Er, Y, Cd, Ho, Hf; the balance is aluminum and foreign elements and impurities. Among the disadvantages, the relatively low values of strength properties should be noted when using alloying elements within the lower range.

A material of RUSAL, described in patent ru2683399c1, is known. The aluminum-based alloy contains (% wt) zirconium 0.10-0.50%, iron 0.10-0.30%, manganese 0.40-

1.5%, chromium 0.15-0.6%, scandium 0.09-0.25%, titanium 0.02-0.10%, at least one element selected from the group: silicon 0.10-0.50%, cerium 0.10-5.0%, calcium 0.10-2.0% and optionally magnesium 2.0 to 5.2%.

A material, claimed by NanoAl and described in application WO2018165012, is known. The alloy contains aluminum, magnesium, manganese, silicon, zirconium and nanoparticles of $Al_3Zr$ L12 with the average size of about 20 nm, in the amount of $20^{21}$ $l/m^3$ and more; besides, the particles contain one or more elements from the group of tin, strontium and zinc; the aluminum alloy in the work-hardened condition has the yield strength of at least about 380 MPa, the ultimate tensile strength of at least about 440 MPa and the elongation of at least about 5% at room temperature; and that in the annealed condition has the yield strength of at least about 190 MPa, the ultimate tensile strength of at least about 320 MPa and the elongation of at least about 18%. Among the disadvantages of the condition alloy, the low level of strength in the annealed condition should be noted.

The prototype is the technical solution known from the invention under U.S. Pat. No. 6,531,004 of Eads Deutschland Gmbh. In particular, the weldable, corrosion-resistant material with the triple-phase Al, Zr, Sc, containing, mainly, (% wt) magnesium 5-6%, zirconium 0.05-0.15%, manganese 0.05-0.12%, titanium 0.01-0.2%, totally 0.05-0.5% of scandium and terbium and optionally at least one additional element selected from the group consisting of several lanthanides, in which scandium and terbium are present as mandatory elements, and at least one element selected from the group that includes copper 0.1-0.2% and zinc 0.1-0.4%; the balance is aluminum and unavoidable impurities of no more than 0.1% silicon.

Among the disadvantages of this material, the presence of rare and expensive elements should be noted. Moreover, this material can be not resistant enough to high-temperature heating during process heating.

INVENTION DISCLOSURE

The objective of the invention is the creation of a new high-strength aluminum alloy, characterized by a low cost and a set of high-level physical and mechanical properties, processability and corrosion resistance, in particular, having a high level of mechanical properties after annealing (temporary resistance minimum 350 MPa, yield strength minimum 250 MPa and elongation minimum 5%) and a high processability during hot and cold deformation.

The technical result is the solution of the objective and ensuring a high processability during deformation processing while increasing the mechanical properties of the alloy due to precipitations of the Zr-containing phase with the crystal lattice of type $L1_2$.

The solution of this objective and the achievement of the specified technical result is ensured by the fact that an alloy is claimed with the structure comprising an aluminum solution, precipitations and an eutectic phase formed by such elements as magnesium, manganese, iron, chromium, zirconium, titanium and vanadium. Besides, the alloy contains additionally silicon and scandium; and at least 75% of the share of each element from the group of zirconium and scandium form precipitations with the lattice of type $L1_2$ in the amount of at least 0.18% vol and the particle size of no more than 20 nm, with the following redistribution of alloying elements (% wt):

| | |
|---|---|
| Magnesium | 4.0-5.5 |
| Manganese | 0.3-1.0 |
| Iron | 0.08-0.25 |
| Chromium | 0.08-0.18 |
| Zirconium | 0.06-0.16 |
| Titanium | 0.02-0.15 |
| Vanadium | 0.02-0.06 |
| Scandium | 0.01-0.28 |
| Silicon | 0.06-0.18 |
| Aluminum and unavoidable impurities | Balance |

SUMMARY OF THE INVENTION

Unexpectedly, it has been found that the effect of the increased level of strength properties is achieved from the combined positive effect of solid-solution hardening of the aluminum solution due to magnesium and secondary phases containing manganese, chromium, zirconium, scandium and vanadium, which are resistant to high-temperature heating. At the same time, due to additional alloying of the alloy with silicon and vanadium, the solubility of zirconium and scandium in the aluminum solution decreases, increasing the volume fraction of the number of precipitation particles with the size of up to 20 nm and improving the efficiency of hardening.

In this instance, the aluminum alloy structure must contain the minimally alloyed aluminum solution and precipitation particles, in particular, phases $Al_6Mn$ with the size of up to 200 nm, $Al_7Cr$ with the size of up to 50 nm and particles of type $Al_3Zr$ and/or $Al_3(Zr, Sc)$ and/or $Al_3(Zr, V)$ with the lattice of type $L1_2$ with the size of up to 20 nm.

The justification of the claimed amounts of alloying components that ensure the achievement of the given structure in this alloy is given below.

Magnesium in the amount of 4.0-5.5% wt is required to increase the overall level of mechanical properties due to solid-solution hardening. If the content of magnesium is higher than the stated content, the effect of this element will lead to a reduction in processability during the metalworking process, for example, when rolling ingots, having a significant negative impact on the yield ratio in deformation. The content below 4% wt will not provide the minimum required level of strength properties.

Zirconium in the amount of 0.06-0.16% wt is necessary to ensure dispersion hardening with the formation of precipitations of phases of type $Al_3Zr$ $L1_2$ or $Al_3(Zr, Sc)$ and/or $Al_3(Zr, V)$ in the presence of relevant elements.

Scandium and vanadium in the amount of 0.01-0.28% wt and 0.01-0.06% wt respectively are necessary to ensure the required level of strength properties due to dispersion hardening with the formation of precipitations of metastable phases additionally containing zirconium with the L12-type crystal lattice.

In general, zirconium, scandium, and vanadium are redistributed between the aluminum matrix and precipitations of the metastable $Al_3Zr$ phase with the lattice of type $L1_2$, and the number of particles is determined by solubility of such elements at the decomposition temperature.

If the concentration of zirconium in the alloy is higher than 0.16% wt, the use of elevated melting temperatures is required, which, in some instances, is not technically feasible under the conditions of semi-continuous casting of ingots.

When using standard casting conditions with the zirconium content of above 0.16% wt, it is possible to form the phase with the lattice of type $D0_{23}$ in the structure of primary crystals, which is unacceptable.

The zirconium, scandium and vanadium content below the stated level will not provide the minimum required level of strength properties due to the insufficient amount of precipitations of secondary phases with the lattice of type $L1_2$.

Chromium in the amount of 0.08-0.18% wt is necessary to increase the overall level of mechanical properties due to dispersion hardening with the formation of the secondary phase of $Al_7Cr$. If the content of chromium is higher than the stated content, the effect of this element will lead to a reduction in processability during the metalworking process, for example, when rolling ingots, which will have a significant negative impact on the yield ratio in deformation. The content below 0.1% wt will not provide the minimum required level of strength properties.

Manganese in the amount of 0.4-1.0% wt is necessary to increase the overall level of mechanical properties due to dispersion hardening with the formation of the secondary phase of $Al_6Mn$. If the content of manganese is higher than the stated content, the effect of this element will lead to a reduction in processability during the metalworking process, for example, when rolling ingots, due to the possible formation of primary crystals, having a significant negative impact on the yield ratio in deformation. The content below 0.3% wt will not provide the minimum required level of strength properties. When the content is higher than 1.0% wt, primary crystals of the $Al_6Mn$ phase, which reduce processability during deformation processing, will be formed.

Silicon is required to reduce the solubility of zirconium, scandium and vanadium in the aluminum solution; as a result, the main effect of these elements will be associated with the increase in supersaturation of zirconium, scandium and vanadium in the aluminum solution during casting of billets, which will ensure the release of more secondary phase dispersoids with the $L1_2$ lattice during subsequent homogenization annealing and improve the effect of dispersion hardening. Moreover, it has been experimentally established that, in the presence of silicon, less than 75% of the share of zirconium and scandium of the alloy, in the range of the claimed concentrations of alloying elements, form precipitations with the lattice of type $L1_2$ in the amount of at least 0.18% vol. With the silicon content of less than 0.08% wt., there has not been any effect as to a reduction in solubility of zirconium and scandium in the aluminum solution. With the content of above 0.18% wt, the crystallization phase of Mg2Si, which reduces processability during hot rolling, is formed and has a negative impact. The presence of the Mg2Si phase is highly undesirable as it does not dissolve during homogenization annealing.

EMBODIMENTS 8 alloys were produced under laboratory conditions, the chemical composition of which is shown in Table 1.

The alloys were prepared in a laboratory induction kiln, with the mass of each cast of at least 14 kg. The following materials were used as charge materials (% wt): aluminum A99 (99.99% Al), magnesium Mg90 (99.90% Mg), alloying compositions Al-10% Mn, Al-10% Fe, Al-10% Cr, Al-5% Zr, Al-5% Ti, Al-3% V, Al-2% Sc, Al-10% Si. The cross section of cast ingots was 200×50 mm, and the length was about 250 mm. The estimated alloys cooling rate in the solidification range did not exceed 2 K/s.

TABLE 1

Chemical composition of experimental alloys (% wt)

| No | Mg | Mn | Fe | Cr | Zr | Ti | V | Sc | Si | Al |
|---|---|---|---|---|---|---|---|---|---|---|
| 1 | 3.8 | 0.2 | 0.01 | 0.01 | 0.03 | 0.01 | — | — | 0.25 | Bal. |
| 2 | 4.0 | 1.0 | 0.08 | 0.18 | 0.06 | 0.15 | 0.02 | 0.28 | 0.18 | Bal. |
| 3 | 4.1 | 0.5 | 0.15 | 0.10 | 0.16 | 0.02 | — | 0.01 | 0.09 | Bal. |
| 4 | 5.0 | 0.6 | 0.15 | 0.13 | 0.10 | 0.08 | — | 0.10 | 0.11 | Bal. |
| 5 | 5.1 | 0.5 | 0.16 | 0.12 | 0.16 | 05 | 0.04 | — | 0.10 | Bal. |
| 6 | 5.1 | 0.5 | 0.25 | 0.12 | 0.08 | 0.08 | 0.06 | 0.06 | 0.08 | Bal. |
| 7 | 5.5 | 0.6 | 0.15 | 0.08 | 0.10 | 0.09 | — | 0.10 | 0.10 | Bal. |
| 8 | 5.8 | 1.1 | 0.27 | 0.19 | 0.18 | 0.17 | — | 0.31 | 0.07 | Bal. |

Cast ingots were homogenized under the conditions when the maximum temperature of heating and holding did not exceed 425° C. Then hot and cold rolling of ingots into sheets was carried out according to the following scheme: hot rolling temperature 450° C. and total deformation degree 90% down to 5 mm, intermediate annealing of the hot-rolled billet at the temperature of 400° C., cold rolling with the total degree of deformation of 30% down to the thickness of 3.5 mm. The mechanical properties of the sheets were determined after annealing at the temperature of 300° C. for 3 hours, the results of which are shown in Table 2. The mechanical properties were evaluated based on the results of the determination of the ultimate tensile strength (UTS), yield strength (YS) and elongation (El). The gauge length of flat specimens was 50 mm, and the test speed was 10 mm/min.

TABLE 2

Mechanical tensile properties of experimental alloys (Table 1) after annealing at 300° C.

| No* | YS, MPa | UTS, MPa | El, % |
|---|---|---|---|
| 1 | 124 | 282 | 27 |
| 2 | 283 | 372 | 19 |
| 3 | 251 | 367 | 21 |
| 4 | 273 | 382 | 16 |
| 5 | 264 | 390 | 16 |
| 6 | 260 | 381 | 15 |
| 7 | 282 | 394 | 15 |
| 8** | — | — | — |

*see the chemical composition in Table 1
**rupture in cold rolling

The amount of precipitations was determined using computational and experimental methods, in particular, using the Thermocalc software package and analysis of the structure of homogenized ingots and annealed sheets of experimental compositions. The results are given in Table 3.

TABLE 3

Amount of precipitations $L1_2$ (% vol) and redistribution of Zr, V and Sc among structural components

| | Volume fraction of precipitation particles | Percentage of the element forming precipitations with the lattice of type $L1_2$, % | |
|---|---|---|---|
| No* | $L1_2$, % | Zr | Sc |
| 1 | 0.02 | 50 | — |
| 2 | 0.76 | 75 | 98 |
| 3 | 0.20 | 91 | 80 |

TABLE 3-continued

| Amount of precipitations $L1_2$ (% vol) and redistribution of Zr, V and Sc among structural components | | | |
|---|---|---|---|
| | Volume fraction of precipitation particles | Percentage of the element forming precipitations with the lattice of type $L1_2$, % | |
| No* | $L1_2$, % | Zr | Sc |
| 4 | 0.36 | 85 | 95 |
| 5 | 0.24 | 91 | — |
| 6 | 0.18 | 81 | 92 |
| 7 | 0.35 | 85 | 95 |

The results show that only compositions 2-7 meet the requirements for the level of strength properties. Composition 8 ruptured during hot deformation processing due to the presence of primary crystals of the AL6(Fe, Mn) phase.

Thus, it is shown that the claimed alloy provides for a high processability during deformation processing, while increasing the mechanical properties of the alloy due to precipitations of the Zr-containing phase with the crystal lattice of type $L1_2$.

The scope of protection in the form of the following set of features suggests itself:

1. Aluminum alloy with the structure, comprising an aluminum solution, precipitations and an eutectic phase, formed by such elements as magnesium, manganese, iron, chromium, zirconium, titanium, vanadium, characterized in that the alloy additionally contains silicon and scandium and at least 75% share of each element from the group of zirconium and scandium form precipitations with the lattice of type $L1_2$ in the amount of at least 0.18% vol and the particle size of no more than 20 nm, with the following redistribution of alloying elements (% wt):

| | |
|---|---|
| Magnesium | 4.0-5.5 |
| Manganese | 0.3-1.0 |
| Iron | 0.08-0.25 |
| Chromium | 0.08-0.18 |
| Zirconium | 0.06-0.16 |
| Titanium | 0.02-0.15 |
| Vanadium | 0.01-0.06 |

-continued

| | |
|---|---|
| Scandium | 0.01-0.28 |
| Silicon | 0.08-0.18 |
| Aluminum and unavoidable impurities | balance. |

2. Material based on the aluminum alloy as per claim 1 for manufacture of products operating in corrosive environments under high loads.
3. Material as per claim 2, characterized in that it has a high level of mechanical properties after annealing, namely, ultimate tensile strength no less than 350 MPa, yield strength no less than 250 MPa and elongation no less than 15%.

The invention claimed is:

1. An aluminum alloy comprising: an aluminum solution, precipitates, and an eutectic phase formed by one or more of magnesium, manganese, iron, chromium, zirconium, titanium, and vanadium, wherein:

the aluminum alloy further comprises silicon and scandium, and at least 75% share of each element from the group of zirconium and scandium of the aluminum alloy form precipitates with a $L1_2$ lattice in an amount of at least 0.18% vol and a particle size of no more than 20 nm, with redistribution of alloying elements (% wt) of:

| | |
|---|---|
| Magnesium | 4.0-5.5 |
| Manganese | 0.3-1.0 |
| Iron | 0.08-0.25 |
| Chromium | 0.08-0.18 |
| Zirconium | 0.06-0.16 |
| Titanium | 0.02-0.15 |
| Vanadium | 0.01-0.06 |
| Scandium | 0.01-0.28 |
| Silicon | 0.08-0.18 |
| Aluminum and impurities | remainder. |

2. The aluminum alloy of claim 1, wherein the aluminum alloy is used to manufacture products operating in corrosive environments under high loads.

3. The aluminum alloy of claim 2, wherein, after annealing, the aluminum alloy has mechanical properties including:

ultimate tensile strength no less than 350 MPa, yield strength no less than 250 MPa, and elongation no less than 15%.

* * * * *